United States Patent [19]

Fritz et al.

[11] 4,046,110

[45] Sept. 6, 1977

[54] STEAM GENERATORS

[75] Inventors: Kurt Fritz, Klosterneuburg; Georg Beckmann, Vienna, both of Austria

[73] Assignee: Waagner-Biro Aktiengesellschaft, Austria

[21] Appl. No.: 571,357

[22] Filed: Apr. 24, 1975

[30] Foreign Application Priority Data

Apr. 25, 1974 Austria ..... 3405/74

[51] Int. Cl.[2] ..... F22B 1/06

[52] U.S. Cl. ..... 122/32; 165/163

[58] Field of Search ..... 122/32, 33, 34; 165/112, 113, 114, 158, 163

[56] References Cited

U.S. PATENT DOCUMENTS

| | | | |
|---|---|---|---|
| 3,147,743 | 9/1964 | Romanos | 122/32 |
| 3,356,135 | 12/1967 | Sayre | 122/32 X |
| 3,807,365 | 4/1974 | Lyman et al. | 122/32 |
| 3,923,008 | 12/1975 | Beckmann et al. | 122/34 |

*Primary Examiner*—Kenneth W. Sprague
*Attorney, Agent, or Firm*—Steinberg & Blake

[57] ABSTRACT

A steam generator having an elongated vessel provided with opposed upper and lower ends and having in its interior adjacent its upper end a single transversely extending tube plate and a partition extending upwardly from said tube plate and dividing the interior space of the vessel above the tube plate into a heating-medium receiving chamber and a heating-medium discharge chamber. A bundle of tubes are connected with and extend downwardly from the tube plate to the region of the lower end of the vessel, each of these tubes having an inlet end communicating with the receiving chamber and an outlet end communicating with the discharge chamber and each of these tubes having a substantially U-shaped configuration at the region of the lower end of the vessel. A feedwater supply communicates with the vessel below the tube plate to supply to the interior of the vessel a liquid to be converted into steam with heat extracted from the heating medium which flows through the tubes from the receiving chamber to the discharge chamber. Above the liquid which is in the vessel there is a steam chamber defined at least in part by a lower surface of the tube plate at that part thereof to which the inlet ends of the tubes are connected, and a steam discharge conduit communicates with the steam chamber to receive live steam therefrom.

6 Claims, 6 Drawing Figures

Fig.1b Fig.1a
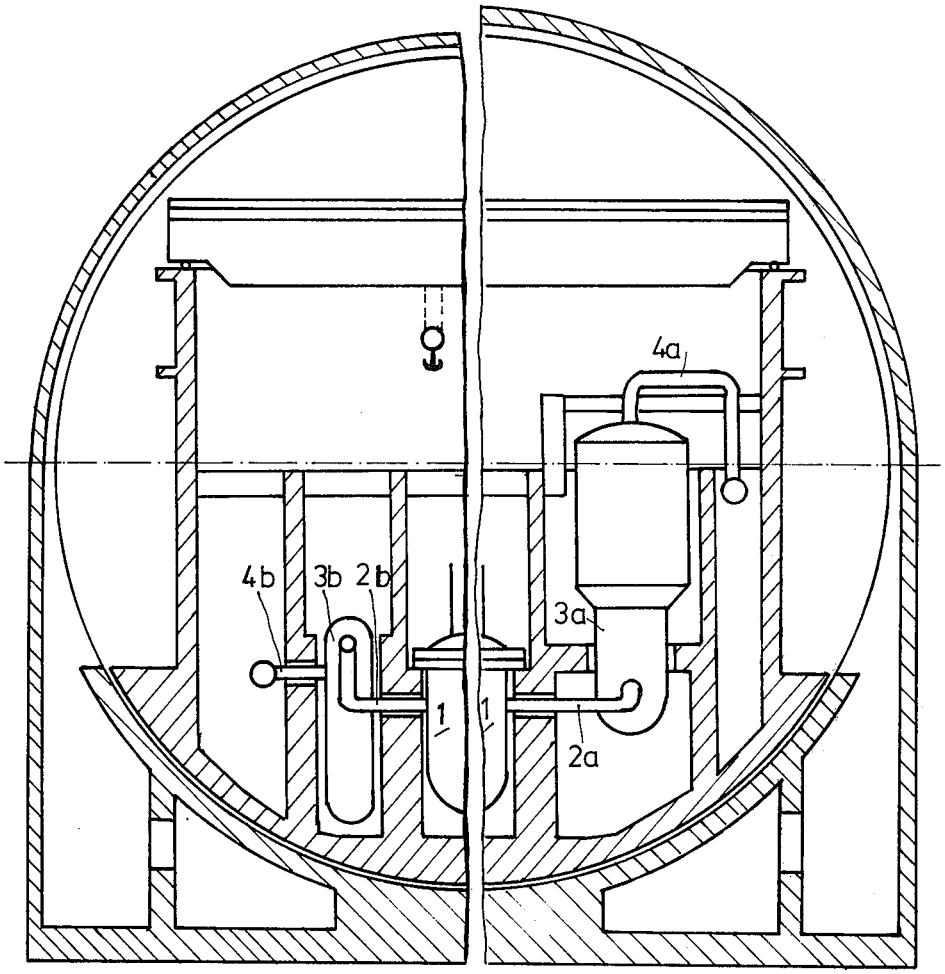
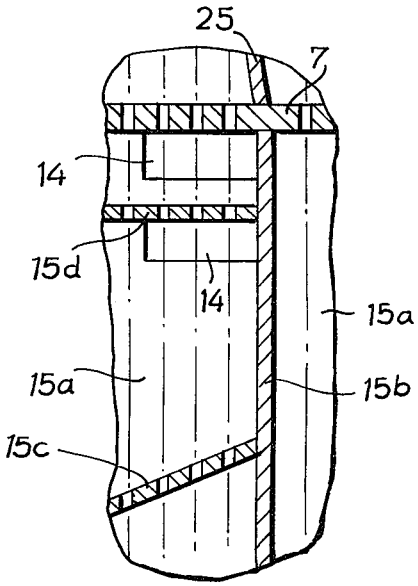
Fig. 3a

STEAM GENERATORS

BACKGROUND OF THE INVENTION

The present invention relates to steam generators.

In particular, the present invention relates to a steam generator having a bundle of U-shaped tubes and a signal tube plate, with the fluid which is to be converted into steam engaging the exterior of the tubes while the medium from which heat is extracted flows along the interior of the tubes.

Conventional steam generators of this general type are capable of generating a wet steam which is dried by utilizing special coarse and fine separating units. Such constructions have drawbacks in that they produce only saturated steam or dry saturated steam, so that only a relatively low thermal efficiency can be achieved. Because of the water separating devices such steam generators are relatively large so that because of the large volume required for such installations, the housing in which they are contained, particularly in the case of nuclear steam generators, are undesirably large. Furthermore, it is conventional to support such upright steam generators at their lower ends. The conduits for the live steam are situated, however, at the opposite upper ends of the steam generators. As a result such conduits for the live steam must be capable of elastically absorbing the entire expansion and contraction of the steam generator and thus have an undesirably great length.

A further drawback of such steam generators results from the manner in which the fluids are circulated. During operation of such steam generators the circulating water becomes rich in impurities with the latter achieving undesirably high concentrations which ultimately bring about corrosion at expansion cracks and intercrystalline corrosion at the location where the austenitic or high-alloy tubes of the steam generator are joined with the tube plate. These corrosion effects are favored by the pronounced deformation of the tubes which is required in connection with the rolling of the ends of the tubes during connection of the latter with the tube plate.

SUMMARY OF THE INVENTION

It is accordingly a primary object of the present invention to provide a steam generator construction which will avoid the above drawbacks.

Thus, one of the primary objects of the present invention is to provide a steam generator installation which requires a considerably smaller space than is required for conventional installations.

Also it is an object of the present invention to provide a construction where corrosion will be sharply reduced.

Furthermore it is an object of the present invention to provide a steam generator which will have a much higher thermal efficiency than conventional steam generators.

In addition, it is an object of the present invention to provide a steam generator which does not require units for separating water from the steam in order to dry the latter.

In addition, it is an object of the present invention to provide a steam generator which can have relatively short pipes connected thereto for the purpose of receiving the generated steam, for example, without requiring such pipes to elastically absorb the expansion and contraction of the steam generator.

Furthermore, it is an object of the present invention to provide a steam generator of relatively simple compact construction which can be precisely regulated in its operation and which also is capable of achieving highly desirable thermal and hydraulic advantages.

According to the invention the steam generator includes a vessel having opposed upper and lower ends and carrying in its interior a tube plate which is situated at the region of the upper end of the vessel while at the same time defining at least part of a steam chamber from which the generated steam is taken. This tube plate has a bundle of tubes connected thereto for directing the heating medium through the interior of these tubes, and the tubes have lower substantially U-shaped ends situated at the region of the lower end of the vessel which may have the configuration of a hemisphere. In this lower end region of the vessel is situated the liquid which is converted into steam. In particular, in the interior of the vessel there is a superheating zone at the hot ends of the tubes where they initially receive the heating medium, and the pipes which carry the live steam away from the vessel are situated in communication with the superheating zone at the region of the tube plate. According to a further feature of the invention the supporting structure which supports the vessel is situated in the region of the tube plate. Preferably at the region of the colder ends of the tubes, where the heating medium discharges from the interiors of these tubes, there is in the vessel a preheating chamber which receives the feedwater and in this preheating chamber the feedwater is directed toward the tube plate, according to one embodiment of the invention. According to a further important feature of the invention the vessel together with the tube plate are situated at an inclined attitude.

BRIEF DESCRIPTION OF DRAWINGS

The invention is illustrated by way of example in the accompanying drawings which form part of this application and in which:

FIG. 1*a* schematically illustrates the right side of a conventional steam generator installation while FIG. 1*b* shows for comparison purposes the left side of a steam generator installation according to the invention so that an example of the reduction in size which can be achieved with the present invention is apparent from a comparison of FIGS. 1*a* and 1*b;*

FIG. 3*a* is a fragmentary sectional elevation showing at an enlarged scale part of the structure of FIG. 2 with the tubes being eliminated for the sake of clarity.

DESCRIPTION OF PREFERRED EMBODIMENTS

Figure 2:
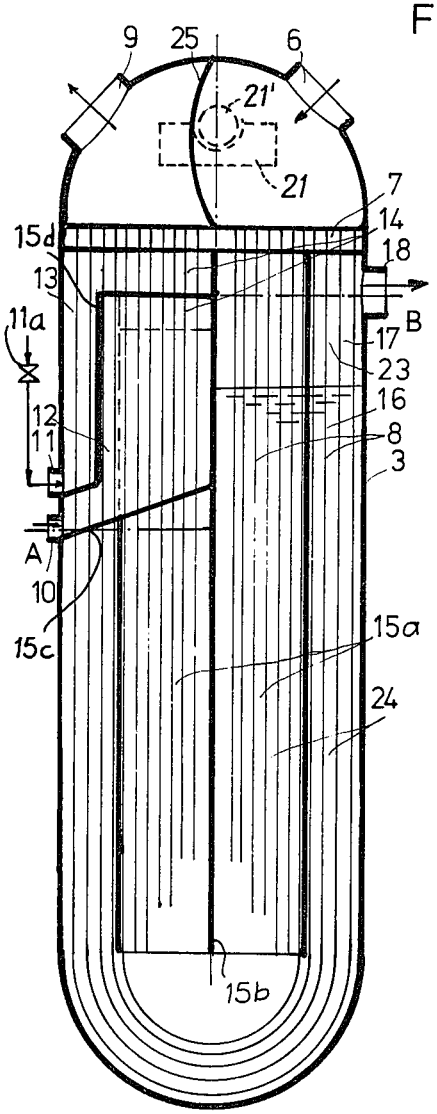
FIG. 2 is a schematic longitudinal sectional elevation of one embodiment of a steam generator according to the invention.

Referring first to FIG. 1*a,* there is schematically illustrated therein a conventional circulating type of steam generator situated within a suitable container housing. The reactor pressure vessel 1 communicates through a conduit 2*a* for the primary heating medium with a lower end region of the steam generator 3*a.* The steam which is generated therein is conducted by way of a live steam conduit 4*a* to a collecting conduit, and it will be noted that the live-steam conduit 4a communicates with the upper end of the generator 3a. As is strikingly apparent from FIG. 1a, with this conventional construction the steam generator has an undesirably large volume as well as an undesirably long conduit 4a for the live steam.

In contrast, FIG. 1b shows the substantial saving of space achieved with a steam generator installation according to the present invention. As will be apparent from the description which follows, with the steam generator 3b of the invention the tube plate is situated adjacent the upper end of the steam generator 3b and for the purpose of providing a stable mounting for the steam generator it is possible to provide a supporting structure adjacent the upper end of the steam generator from which the entire steam generator hangs, this latter type of support being made possible by situating the tube plate adjacent the upper end of the steam generator. The conduit 2b for the primary heating medium from the pressure vessel 1 communicates with an upper end region of the generator 3b, and the live steam conduit 4b also communicates with an upper region of the generator 3b. Thus, the conduits 2b and 4b communicate with a part of the generator 3b where the support means from which the generator hangs is also located, so that in this way these conduits 2b and 4b can be made relatively short and need not participate to any appriciable extent in the contraction and expansion of the steam generator. In this way these conduits 2b and 4b can be insulated from the expansion and contraction of the steam generator. From the upper part of FIG. 1b it is clear that the size of the housing which contains the insulation can be reduced as compared with the conventional construction shown in FIG. 1a.

Referring now to FIG. 2, the steam generator of the present invention which is illustrated therein includes an elongated upright vessel 3 which may be circular in cross section and of a constant diameter between its upper and lower ends which may have the configuration of hemispheres, as illustrated in FIG. 2. At the region of its upper end the vessel 3 carries in its interior a tube plate 7 which extends transversely across the interior of the vessel and has its outer periphery directly in engagement with the inner surface of the vessel 3. Thus, the tube plate 7 is of a circular configuration and has an exterior periphery conforming to the inner diameter of the vessel, this plate 7 being situated substantially in a diametral plane of the upper hemisphere which forms the upper part of the vessel 3.

The space within the vessel 3 above the tube plate 7 is divided by a partition means 25 into a right chamber, as viewed in FIG. 2, which forms a heating-medium receiving chamber receiving, for example for the presure vessel 1, the hot heating medium delivered to this chamber at the right of the partition means 25 by way of a suitable conduit 6 which of course corresponds to the conduit 2b of FIG. 1. At the left of the partition means 25 over the plate 7 as viewed in FIG. 2, is a discharge chamber for the heating medium, the cooled heating medium discharging from this chamber by way of a suitable conduit or connection 9. It will be noted that the partition means 25 is in the form of a wall which bulges or is curved toward the lower pressure discharge chamber for the heating medium.

A bundle of tubes 8 is connected with the tube plate 7 and extends downwardly therefrom to the rear end region of the vessel 3. Each of the tubes has an upper inlet end communicating through the tube plate 7 with the chamber on the right side of the partition 25, as viewed in FIG. 2, so that the heating medium enters into the interior of the tubes of the bundle 8 through the upper inlet ends thereof. These tubes of the bundle 8 also have upper outlet ends fixed to the tube plate 7 and communicating through the latter with the discharge chamber at the left side of the partition 25 from which the cooled heating medium discharges by way of the discharge means 9. At the lower end regions each of the tubes in the bundle 8 has a substantially U-shaped configuration conforming to the hemispherical configuration of the lower end of the vessel 3. Thus the heating medium will enter above the plate 7 at the right side of the partition 25, and will flow downwardly along the tubes 8, through the U-shaped lower ends thereof, and then upwardly along the interiors of the tubes 8 out through the discharge chamber at the left side of the partition 25. This discharge chamber at the left side of the partition 25, as viewed in FIG. 2, of course has a lesser pressure than the receiving chamber at the right side of the partition 25.

Figure 3:
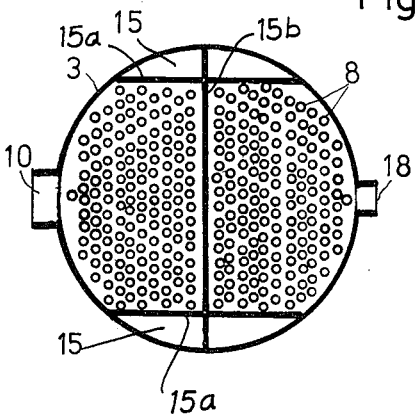
FIG. 3 is a schematic transverse sectional plan view taken along line A–B of FIG. 2.

In the example which is shown in FIG. 2, there is a feedwater supply means for supplying to the interior of the vessel 3 below the tube plate 7 a liquid to engage the tubes 8 at the exterior thereof for extracting heat from the heating medium flowing through the interiors of the tubes 8, so that this liquid medium will be converted into steam. This particular feedwater supply means of FIG. 2 includes a pair of supply conduits 10 and 11 which through suitable valves or the like are capable of being separately requlated for controlling the feedwater supply through the conduits 10 and 11 in a manner according to which the regulation through one of the conduits 10 or 11 may be independent of the regulation for the supply through the other of these conduits. In the example of FIG. 2, the interior of the vessel is provided with a wall means which defines a preheating chamber which receives the liquid supplied by way of the feedwater supply means 10, 11. This wall means includes upper portions of a pair of opposed walls 15a. Each of these walls 15a extends parallel to the longitudinal axis of the vessel 3 in the interior thereof. It is apparent from FIG. 3 that the pair of opposed walls 15a define between themselves an interior space, beneath the tube plates 7, where the bundle of tubes 8 is situated. Outwardly of the walls 15a there are no tubes so that each wall 15a defines with the vessel 3 an outer duct which has no tubes therein and through which the water reaches the lower part of the vessel, in a manner described in greater detail below. A wall 15b (FIG. 3) contains the axis of the vessel 3 and extends perpendicularly with respect to the walls 15a across and beyond the latter into engagement with the inner surface of the vessel 3, as is apparent from FIG. 3. These walls 15a and 15b are fixed at their upper edges to the lower surface of the tube plate 7 extending downwardly from the latter to the upper end of the hemisphere which forms the lower end of the vessel 3.

The wall means which defines the preheating chamber of FIG. 2 includes a lower transverse wall 15c which extends between and is fixed to the walls 15a, this wall 15c being inclined as illustrated in FIG. 2 and having a lower left edge situated just beneath the supply conduit 10 while having an opposed upper edge fixed to and extending along the wall 15b between the pair of opposed walls 15a. The wall means which defines the preheating chamber of FIG. 2 also includes an upper stepped wall 15d having its left lower end fixed to the inner surface of the vessel 3 between the supply conduits 10 and 11, this stepped wall 15*d* having next to its left inclined lower end region a vertically extending portion which joins with a horizontally extending portion situated below and adjacent while extending parallel to the tube plate 7. Thus this wall 15*d* also is fixed to and extends between the pair of walls 15*a* and has its right edge fixed to and extending along the wall 15*b*. In this way the preheating chamber of FIG. 2 has an upper preheating chamber portion 13 and a lower preheating chamber portion 12. Each of the walls 15*a* is provided with a pair of window-like openings 14, shown most clearly in FIG. 3*a*, through which the preheated liquid flows from the preheating chamber portions 12 and 13 into a duct 15 to fall without obstruction downwardly along each duct 15 to the lower end region of the vessel 3.

As a result of the above construction it will be seen that the unobstructed ducts 15 for the preheated liquid have the configuration, in cross section, of segments of a circle. The liquid supplied by way of the conduit 11 flows upwardly first concurrently with the heating medium flowing through the interiors of upper portions of tubes 8 situated within the upper preheating chamber portion 13, and then this liquid flows in the chamber 13 transversely across the outlet end regions of the tubes 8 in the preheating chamber portion 13 to the openings 14 just beneath the plate 7 through which the preheated liquid in the upper preheating chamber portion 13 flows to the ducts 15 shown in FIG. 3. The supply through the conduit 11 is automatically controlled as by an automatically regulated valve 11*a*. This valve is automatically regulated so as to maintain the temperature of the water in the upper chamber 13 constant and thus at the connection between the outlet ends of the tubes 8 and the plate 7 a constant temperature is maintained so as to reduce the stresses at the connection between the tube plate 7 and the outlet ends of the tubes 8. The temperature of the liquid in the upper chamber 13 is maintained constant even though the load in the generator may vary. It will be noted that in the lower preheating chamber portion 12 the liquid received through the conduit 10 is also directed concurrently with the heating medium in the tubes 8 as well as transversely across the tubes 8 before reaching the lower openings 14 of the pair of walls 15*a*.

Thus, the preheated liquid will reach the lower liquid zone 24 in the vessel 3, an upper part 16 of the zone in the vessel 3 which receives the liquid forming the zone where the liquid is converted into steam. The steam which flows upwardly from the steam generating zone 16 reaches a steam chamber 23 situated above the liquid in the vessel at the right of the wall 15*b*, as viewed in FIGS. 2 and 3, where the upper inlet end regions of the tubes are situated and where the heating medium is at its highest temperature. This upper steam chamber 23 includes a superheating zone 17 located at the hot ends of the tubes 8 in the vessel, and a live-steam discharge means 18 communicates with the superheating zone 17 for receiving superheated steam therefrom. Thus with the steam generator of the invention the liquid supplied by way of the feedwater supply means 10, 11 is converted in the vessel 3 into superheated steam discharged from the vessel by way of the discharge means 18, and thus dryers for saturated steam are not required.

It will be seen that part of the superheating zone 17 of the steam chamber 23 is defined by the lower surface of the tube plate 7 at the part of the latter which is connected with the inlet ends of the tubes 8.

With the above-described embodiment of the invention it is possible to achieve certain important advantages particularly by way of the construction of the preheating means according to which in the upper and lower chamber portions 13 and 12 thereof the liquid is preheated while flowing concurrently with and across the tubes 8 at the region where the heating medium approaches the tube plate 7, before discharging out of the tubes 8. However, it is also possible to achieve important advantages with the invention by way of a different embodiment illustrated in FIG. 4. It will be noted from FIG. 2 that the vessel 3 is supported by a support means which includes a pair of opposed stationary bearing blocks 21 formed with upper notches of substantially semicircular configuration receiving a pair of opposed relatively short coaxial stub shafts 21' which are fixed to vessel 3 in the region of tube plate 7 and which are seated in the upwardly directed semicircular notches of the stationary fixed blocks 21. Thus, the support means 21, 21' is operatively connected with the vessel 3 at the upper end region thereof adjacent the tube plates 7 with the entire vessel 3 being hung from this support means so that it is possible for the vessel 3 to expand and contract while hanging freely from the support means while at the same time the discharge conduit 18 as well as each of the feedwater supply conduits 11 and 12 of FIG. 2 need not participate in the expansion and contraction of the vessel to any appreciable extent. According to the embodiment of FIG. 4, however, although the same support means 21, 21' is used, the vessel 3 is maintained at an inclined attitude as illustrated. This is brought about by way of the block 22 which frictionally engages a lower portion of the vessel 3. Thus the lower portion of the vessel 3 is provided with a narrow projection 22' which has a flat surface engaging and freely slidable along the flat surface of the block 22 which by way of any suitable adjusting structure can be moved horizontally to the left and right, as shown by the double-headed arrow 22''. As a result while the support means includes the supporting structure 21, 21' as described above it also includes the block 22 which frictionally engages the vessel 3 in such a way that the vessel 3 is maintained at an inclined attitude as illustrated and at the same time is capable because of its frictional engagement with the block 22 of freely expanding and contracting with respect to the support means 21, 21' from which the vessel 3 is hung.

Figure 4:
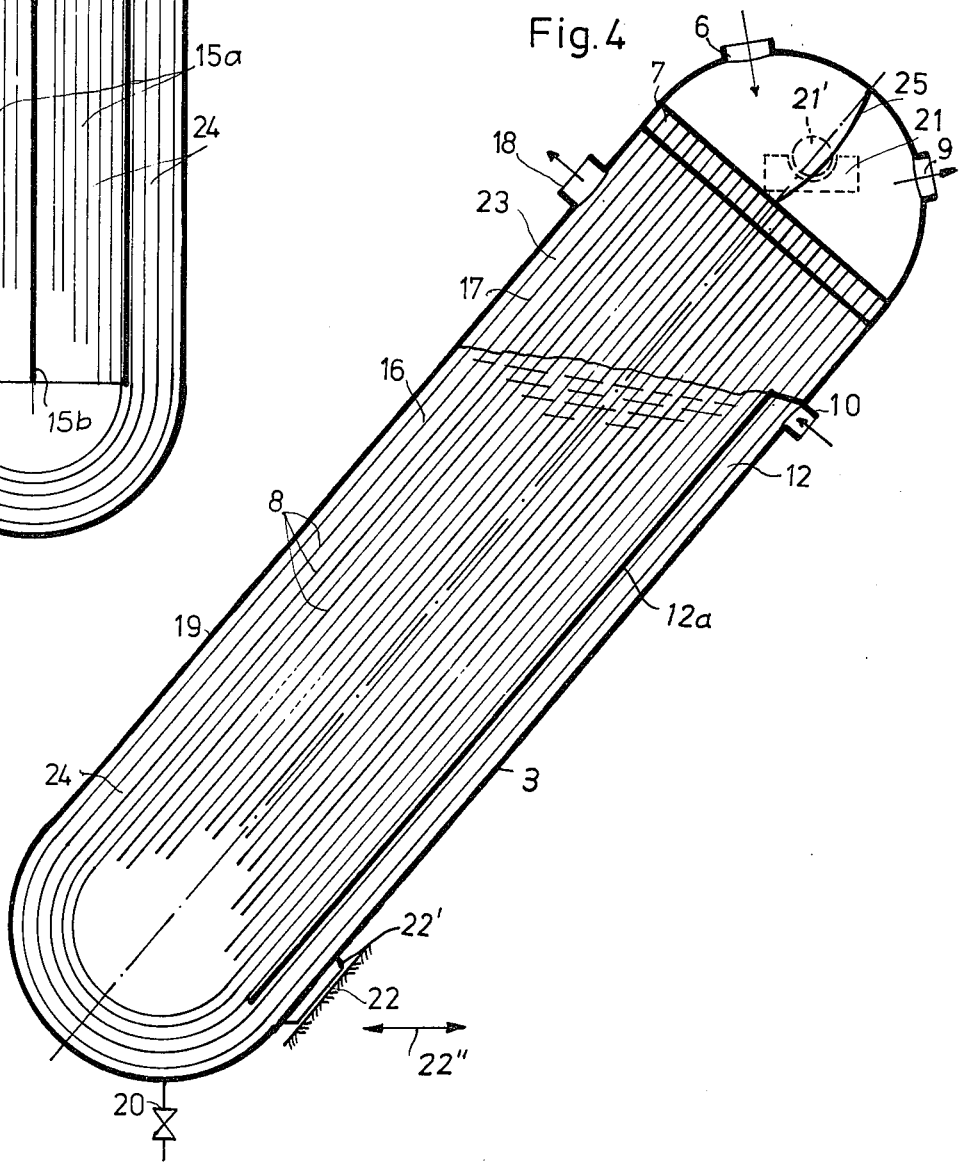
FIG. 4 is a schematic illustration of a further embodiment of the invention.

The embodiment of FIG. 4 is much simpler than that of FIG. 2 with respect to the fact that in the embodiment of FIG. 4 there is no wall means as described above in connection with FIGS. 2, 3 and 3*a* defining preheating chambers and ducts for the preheated liquid. Instead with the embodiment of FIG. 4 there is a much simpler preheating chamber 12 defined by a relatively simple wall means 12*a* extending to the longitudinal axis of the vessel 3 at the lower side of this axis and having its opposed side edges fixed to the inner surface of the vessel 3 so as to define with the latter an elongated duct of substantially the configuration of a segment of a circle in cross section. This wall 12*a* has an upper end situated just above the supply conduit 10 for the feedwater, so that with this construction the feedwater flows downwardly along the inner lower surface region of the vessel 3 at the side of the latter which is directed downwardly as viewed in FIG. 4. It will be noted that with FIG. 4 the tube plate 7 is also inclined, this plate 7 being perpendicular to the longitudinal axis of the vessel, and the entire bundle of tubes 8 is positioned as illustrated in FIG. 4 with the discharge chamber for the heating medium situated in the embodiment of FIG. 4 at the lower side of the plate 7 while the receiving chamber which receives the heating medium is situated at the upper side of the tube plate 7, as viewed in FIG. 4. Thus, with the embodiment of feedwater supply means 10 will supply to the interior of the vessel a liquid which flows through the preheating chamber 12 downwardly in the direction which is in countercurrent to the upwardly flowing heating medium which flows upwardly along the tubes 8 which are in the preheating chamber 12 toward the plate 7 at the lower side of the latter is viewed in FIG. 4. This preheated liquid will thus reach the lower end region of the vessel 3 where the water chamber 24 is located, and this water in the chamber 24 will be converted into steam in the higher steam chamber 23 which includes the superheating zone 17 which in this case is limited by the entire lower surface of the tube plate 7. As is shown in FIG. 4, the discharge means 18 for the live steam which is in superheated condition communicates with the interior of the vessel 3 at the superheating zone 17 thereof at an elevation which is just below the plate 7 but at the upper side of the vessel 3 at the region thereof opposite from the supply 10 for the liquid which is to be converted into steam. Inasmuch as the entire lower surface of the tube plate 7 is in engagment with hot steam with the embodiment of FIG. 4, the plate 7 is uniformly heated and thus thermal stressing of the plate 7 is greatly minimized.

As a result of the inclined attitude of the steam generator of FIG. 4, the is in the steam generating zone which includes the water chamber 24 an intense natural circulation of the liquid resulting from the concentration of the upwardly flowing steam bubbles at the inner surface of the wall 19 of the vessel 3 along the upper inclined side of this wall 19. As a result of this natural circulation resulting from the inclined attitude of the generator shown in FIG. 4 the thermal or heat transfer is improved and the steam separation is facilitated.

At the lowest part of the vessel 3 where the water chamber 24 is located there is a blowoff pipe 20 through which residues may be discharged out of the vessel of the steam generator.

The improved circulation of the liquid in the embodiment of FIG. 4 results from the fact that the upwardly rising steam bubbles collect to a great extent at the inner cylindrical surface of the upper wall region of the steam generator vessel. Thus, the steam bubbles have a tendency to rise in a generally vertical direction, and a large part of these bubbles will flow upwardly into engagement with the inner surface of the wall 19 at the upper side thereof which is situated above the longitudinal axis of the vessel. In this way a relatively large number of steam bubbles travel upwardly along the inner upper surface region of the vessel while becoming united to an increasing extent with additional upwardly travelling steam bubbles so that the latter become concentrated. The upwardly flowing steam bubbles bring about an upward flow of the liquid due to the fact that the liquid tends to flow along with the steam bubbles so that longitudinally of the upper side of the vessel 3, at the side thereof which is above the longitudinal axis, there is created an upward flow in the liquid within the vessel. This upward flow created at the upper side of the vessel by the concentrated steam bubbles is compensated in a fully automatic manner by downward flow of the boiling preheated liquid in the preheating chamber 12, so that in this way a natural circulation of the liquid in the vessel is achieved. This natural flow is extremely intense and directed in preheated paths as a result of the inclination of the vessel. These paths of circulation of the liquid do not undesirably interfere with each other since they are sharply defined. Such interference of individual flow paths for different parts of the liquid is encountered in conventional steam generators where the individual steam bubbles all flow upwardly without any concentration of bubbles in a particular inclined direction as is the case with the embodiment of FIG. 4. Thus this interference of the individual paths of flow of the liquid encountered in conventional steam generators is avoided with the embodiment of FIG. 4. As a result there is an improvement in the transfer of heat so that it is possible to further reduce the size of the steam generator while achieving the same output.

With the above-described embodiments of the invention it is possible to achieve a number of advantages as follows:

1. Corrosion in cracks at the region of the tube plate is avoided because the tube plate is engaged only by steam or in the case of FIG. 2 partly with preheated water maintained at a constant temperature as described above.
2. By way of the preheating chambers the temperature differential in the generator is better utilized so that the entire area of the heating surfaces may be reduced.
3. Thermal stressing in the region of the tube plate is reduced since the feedwater in the case of FIG. 2 is initially brought in the preheating chamber portion 13 almost up to the boiling temperature and only then engages the tube plate.
4. As a result of the superheating of the live steam in the generator itself an improved thermal efficiency is made possible so that for a given amount of electrical power the generator of the invention requires only a small thermal output so that the steam generator of the invention and thus the entire primary system can be correspondingly reduced.
5. By utilizing the bundle of U-shaped tubes and eliminating the liquid separating units it is possible to reduce the size and in particular the weight of the steam generator installation while achieving the same output as conventional installations.
6. Inasmuch as the supply conduit for the primary heating medium and the discharge conduit for the live steam communicate with the vessel of the steam generator at the region of the support means from which the vessel is suspended these conduits for the heating medium and the live steam need absorb only a small extent of expansion and contraction of the steam generator.
7. Because of the compact construction, the short pipe lengths, and the improved efficiency of the steam generator of the invention, it is possible to reduce the water and steam volumes in the primary as well as in the secondary systems so that the volume of the containment housing may be reduced on the order of 6%, as is apparent from a comparison of FIG. 1*b* with FIG. 1*a*.
8. Because of the inclined position of the steam generator illustrated in FIG. 4 it is possible to achieve an improved fluid circulation without requiring circulating pumps or other devices for circulating the fluid, so that the thermal transfer in the steam generating zone is intensified.

9. By utilizing a concurrent flow for the feedwater in the preheating chamber portions 12 and 13 of FIG. 2, advantages of a thermo-hydraulic nature as well as advantages with respect to precision of regulation are achieved.

What is claimed is:

1. In a steam generator, an elongated vessel having opposed upper and lower ends, said vessel carrying a tube plate extending transversely across the interior of said vessel adjacent said upper end thereof and said vessel carrying in its interior above said tube plate a partition means dividing the space in said vessel above said tube plate into heating-medium receiving and discharge chambers, heating-medium supply means communicating with said heating-medium receiving chamber for supplying a fluid heating medium thereto, heating-medium discharge means communicating with said discharge chamber for discharging the heating medium therefrom, a bundle of tubes situated in said vessel and extending from said tube plate to the region of the lower end of said vessel, each of said tubes having an inlet end communicating through said tube plate with said receiving chamber and an outlet end communicating through said tube plate with said discharge chamber while each tube has a substantially U-shaped end situated at the region of said lower end of said vessel, so that the heating medium delivered to said receiving chamber flows through said inlet ends of said tubes along the interior thereof to said outlet ends thereof before reaching said discharge chamber, feedwater supply means communicating with the interior of said vessel below said tube plate for supplying to the interior of said vessel a liquid which occupies a region of the interior of said vessel situated below said tube plate to be heated by the heating medium flowing through said tubes and to be converted by the heating medium into steam, said vessel having a steam chamber situated in its interior above the liquid supplied by said feedwater supply means and defined at least in part by a lower surface of said tube plate which is directed toward said lower end of said vessel, and steam-discharge means communicating with the interior of said vessel at said steam chamber thereof for the discharging steam from said steam chamber, said vessel having a longitudinal axis with said upper end of said vessel being situated along the latter axis at an elevation higher than said lower end of said vessel, and support means supporting said vessel at an inclined attitude with said lower end of said vessel situated at an elevation lower than but out of line with said upper end of said vessel, and with said tube plate extending transversely across said axis and also being inclined with respect to a vertical plane so that on one side of said axis said tube plate is higher than at an opposite side of said axis.

2. The combination of claim 1 and wherein said support means includes a supporting structure connected to said vessel at the region of the upper end thereof in the vicinity of said tube plate and from which the vessel hangs while said support means also includes a block frictionally engaging a part of said vessel below said supporting structure and maintaing said vessel at its inclined attitude with respect to said supporting structure while at the same time permitting the entire vessel to expand and contract freely at all parts which extend downwardly from said supporting structure.

3. The combination of claim 1 and wherein said heating-medium receiving chamber and said inlet ends of said tubes as well as said steam discharge means are situated at the upper side of said tube plate.

4. The combination of claim 3 and wherein said feedwater supply means communicates with said vessel at a downwardly directed part thereof lower than said tube plate and at the lower side of said tube plate.

5. The combination of claim 4 and wherein said vessel has in its interior a wall means defining a preheating chamber with which said feedwater supply means communicates, said wall means extending longitudinally along the interior of said vessel substantially parallel to said longitudinal axis thereof between said axis and a downwardly directed lower side of said vessel for directing liquid delivered by said feedwater supply means in countercurrent with respect to heating medium flowing in said tubes upwardly toward said tube plate.

6. The combination of claim 5 and wherein the steam chamber in said vessel above the liquid therein extends across the entire interior of said vessel and is free and unobstructed, containing only said tubes and being limited at its upper end by a lower surface of said tube plate whereby a natural circulation of the liquid takes place downwardly in said preheating chamber and upwardly along an inner surface of said vessel which is at an upper side thereof opposed to said preheating chamber.

* * * * *